US010442606B2

(12) United States Patent
Snyder et al.

(10) Patent No.: US 10,442,606 B2
(45) **Date of Patent: *Oct. 15, 2019**

(54) CONTAINER WITH IMPROVED CLOSURE MEANS

(71) Applicant: PHILIP MORRIS PRODUCTS S.A., Neuchatel (CH)

(72) Inventors: Anthony Snyder, Le Mont sur Lausanne (CH); Onesio Luis Thesing, Ecublens (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

This patent is subject to a terminal disclaimer.

(21) Appl. No.: 15/736,877

(22) PCT Filed: Apr. 12, 2017

(86) PCT No.: PCT/EP2017/058857

§ 371 (c)(1),
(2) Date: Dec. 15, 2017

(87) PCT Pub. No.: WO2017/207157

PCT Pub. Date: Dec. 7, 2017

(65) Prior Publication Data

US 2018/0170658 A1 Jun. 21, 2018

(30) Foreign Application Priority Data

May 31, 2016 (EP) ..... 16172297

(51) Int. Cl.
*B65D 85/10* (2006.01)

(52) U.S. Cl.
CPC ..... *B65D 85/1045* (2013.01); *B65D 85/1081* (2013.01)

(58) Field of Classification Search
CPC .. B65D 5/0281; B65D 85/10; B65D 85/1036; B65D 85/1045; B65D 85/1081
(Continued)

(56) References Cited

U.S. PATENT DOCUMENTS 7,731,024 B2 6/2010 Bouno
8,567,598 B2 10/2013 Gibson
(Continued)

FOREIGN PATENT DOCUMENTS

CN 101102945 1/2008
CN 104870324 8/2015
(Continued)

OTHER PUBLICATIONS

Notice of Allowance issued in Korea for Application No. 10-2017-7036071 dated Jun. 20, 2018 (3 pages). English translation included.
(Continued)

*Primary Examiner* — Bryon P Gehman
(74) *Attorney, Agent, or Firm* — Mueting, Raasch & Gebhardt, P.A.

(57) ABSTRACT

A container (100) for consumer goods comprises: a housing (20) having an opening for accessing the consumer goods; and a lid (40) connected to the housing (20) and movable relative to the housing (20) between a closed position in which the lid (40) covers the opening and an open position in which the opening is uncovered. A first surface of the lid (40) is disposed adjacent to a first surface of the housing (20) when the lid is in the closed position, and a microsuction structure (60) is provided for securing the first surface of the lid (40) to the first surface of the housing (20) when the lid (40) is in the closed position. The microsuction structure (60) is formed of a microsuction layer (68); a polymeric film layer (66) underlying the microsuction layer; and an adhe-
(Continued)

Figure 1:
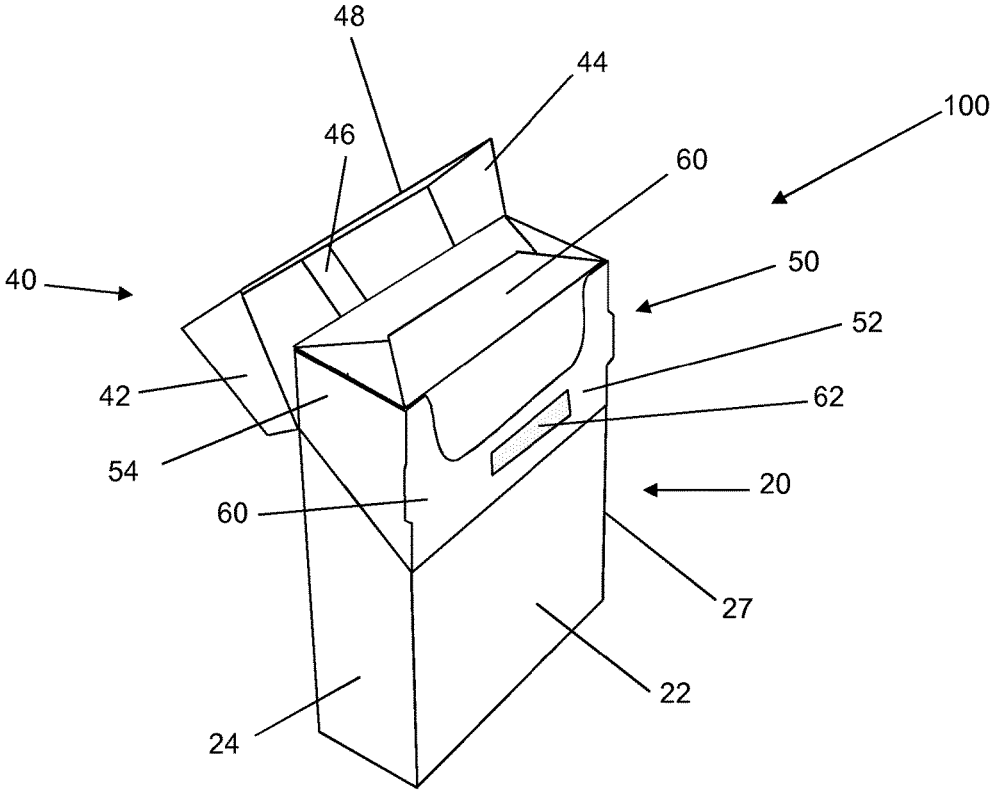

sive layer (64) affixing the microsuction structure to the corresponding first surface of the lid or housing.

15 Claims, 1 Drawing Sheet

(58) Field of Classification Search
USPC ..... 206/264–270
See application file for complete search history.

(56) References Cited

U.S. PATENT DOCUMENTS

| | | | |
|---|---|---|---|
| 9,132,605 | B2 | 9/2015 | Nguyen |
| 2015/0041346 | A1 | 2/2015 | Seyfferth De Oliveria |
| 2015/0305402 | A1 | 10/2015 | Bourgoin |

FOREIGN PATENT DOCUMENTS

| | | | | |
|---|---|---|---|---|
| DE | 102014013821 | | 3/2016 | |
| EP | 1837293 | | 9/2007 | |
| EP | 2594507 | A1 * | 5/2013 | ..... B65D 85/1045 |
| EP | 2845498 | | 3/2015 | |
| JP | 10158608 | | 6/1998 | |
| JP | 3184144 | U | 6/2013 | |
| JP | 2014-088037 | A | 5/2014 | |
| JP | 2016-506341 | A | 3/2016 | |
| KR | 1020140124367 | | 10/2014 | |
| KR | 10-2018-0002869 | | 1/2018 | |
| RU | 2349520 | | 3/2009 | |
| RU | 2524903 | | 8/2014 | |
| WO | WO 2013/068500 | | 3/2013 | |
| WO | WO-2013076012 | A1 * | 5/2013 | ..... B65D 85/1045 |
| WO | WO 2014/096427 | | 6/2014 | |
| WO | WO 2016/045774 | | 3/2016 | |
| WO | WO 2016/059077 | | 4/2016 | |
| WO | WO-2016059077 | A1 * | 4/2016 | ..... B65D 75/5838 |
| WO | WO 2017/036991 | | 3/2017 | |
| WO | WO 2017/207667 | | 12/2017 | |

OTHER PUBLICATIONS

Office Action issued in China for Application No. 20178001993.6 dated Jul. 2, 2018 (10 pages). English translation included.
Office Action issued in Korea for Application No. 2017-7036071 dated Feb. 19, 2018 (10 pages). English translation included.
European Extended Search Report for Application No. 16172297.0 dated Nov. 21, 2016 (7 pages).
Office Action issued in Japan for Application No. 2017-567153 dated Jul. 17, 2018 (6 pages). English translation included.
Office Action issued in Russia for Application No. 2017143764 dated Apr. 18, 2018. English translation included.
International Search Report and Written Opinion for PCT/EP2017/058857dated Jun. 14, 2017 (11 pages).

* cited by examiner

CONTAINER WITH IMPROVED CLOSURE MEANS

This application is a U.S. National Stage Application of International Application No. PCT/EP2017/058857, filed Apr. 12, 2017, which was published in English on Dec. 7, 2017, as International Publication No. WO 2017/207157 A1. International Application No. PCT/EP2017/058857 claims priority to European Application No. 16172297.0 dated May 31, 2016.

The present invention relates to a container for consumer goods having a housing and a lid movable relative to the housing. Containers according to the present invention find particular application as containers for smoking articles, such as cigarettes.

It is known to package elongate smoking articles and other consumer goods in containers formed from folded laminar blanks. Elongate smoking articles, such as cigarettes and cigars, are commonly sold in hinge-lid packs having a box for housing the smoking articles and a lid connected to the box about a hinge line extending across the back wall of the container. The hinge-lid pack may also comprise an inner frame secured to an inner surface of the box, the inner frame having front and side walls against which the lid closes. Such packs are typically constructed from laminar cardboard blanks. In use, the lid is pivoted about the hinge line to open the pack and so gain access to the smoking articles held in the box.

In many cases, it is important to ensure that the lid remains in the closed position during normal handling, so that, for example, the consumer goods do not accidentally get exposed or fall out of the container. For smoking articles it can be particularly important that the lid remains tightly shut in the closed position, so that the freshness of the articles can be preserved.

Various mechanisms have been proposed for improving the interaction between the lid and the box of such containers, and in particular, for reducing the chances of the lid inadvertently moving away from the closed position during normal handling. For example, retention cuts may be provided on the inner frame for interacting with the lid. Alternatively, a temporary adhesive may be provided on the lid or the box. However, such mechanisms deteriorate and become less effective after several repetitions of opening and closing of the lid. This can be particular problematic for containers containing smoking articles, where a consumer may need to open and close the lid on multiple occasions each time they access an individual smoking article.

Furthermore, where an adhesive is provided on the lid or box loose material from the consumer goods—such as loose tobacco material from a smoking article—can become undesirably stuck to the adhesive during use of the container. This can result in an undesirable appearance of the container and a less effectively functioning closing mechanism. This can also create a gap that can allow air to pass into the container when the lid is in a closed position, which can result in an undesired change in the moisture level of the consumer goods.

It would be desirable to provide a container having improved closure means for retaining the lid in a closed position during normal handling. It would be further desirable to provide such a container wherein the closure means retains effectiveness after repeated closure and opening without significant deterioration. It would be particularly desirable to provide such a container that can be manufactured without significant modification of existing container designs or packaging equipment and techniques.

According to the present invention, there is provided a container for consumer goods, the container comprising: a housing having an opening for accessing the consumer goods; and a lid connected to the housing and movable relative to the housing between a closed position in which the lid covers the opening and an open position in which the opening is uncovered. A first surface of the lid is disposed adjacent to a first surface of the housing when the lid is in the closed position, and according to the invention, a microsuction structure is provided on the first surface of the housing, the first surface of the lid, or both the first surface of the housing and the first surface of the lid, for securing the first surface of the lid to the first surface of the housing when the lid is in the closed position. The microsuction structure comprises: a microsuction layer, at least part of which is exposed at the outer surface of the microsuction structure; a polymeric film layer underlying the microsuction layer; and an adhesive layer underlying the polymeric film layer and affixing the microsuction structure to the corresponding first surface of the lid or housing.

The microsuction structure of container according to the invention provides a novel and improved closure means for retaining the lid of the container in a closed position between uses.

The term "microsuction structure" is used herein to refer to the laminate structure formed with the microsuction layer, the polymeric film layer and the adhesive layer. The microsuction layer provides the outer surface of the microsuction structure. The microsuction structure is typically provided in the form of a sheet like laminate material.

In containers according to the invention, the microsuction structure is provided over one or both of the first surface of the housing and the first surface of the lid.

The term "microsuction layer" is used herein to refer to a layer formed of a flexible material having a plurality of micro cavities on the external surface of the material. The walls of the micro cavities are deformable, such that, when the external surface of the material is pressed against a contact surface, a sealed environment of reduced pressure is formed between the walls of the cavities and the contact surface. This provides a suction force between the walls of the cavities and the contact surface.

The micro cavities may have a diameter of from 5 micrometers to 300 micrometers. The material may be formed of an expanded resin having a plurality of internal air bubbles. The layer may have a thickness of from about 50 micrometers to about 150 micrometers, more preferably from about 60 micrometers to about 100 micrometers, most preferably about 80 micrometers.

According to the invention, at least a part of the microsuction layer is exposed at the first surface onto which the microsuction structure is applied, in order to provide the areas of the container that are capable of repeatedly attaching or affixing to the adjacent first surface. The area or areas of the microsuction structure in which the microsuction layer is exposed are referred to herein as the "resealable areas". The microsuction layer may be exposed over the entire first surface to which it is applied, in which case the resealable area has the same surface area as the microsuction structure. Alternatively, the microsuction layer may only be exposed over specific areas of the microsuction layer, as described in more detail below. In this case, the total surface area of the resealable areas will be smaller than the surface area of the microsuction structure. In either case, the total surface area of the microsuction structure corresponds to the surface area of the first surface.

The term "exposed" is used herein to indicate that said areas are not covered and are therefore able to come into contact with and repeatedly attach to and detach from the contact surface. The resealable areas may be capable of creating at least a partially sealed environment within the container. Alternatively, the resealable areas may simply provide areas of the container that can be repeatedly attached or affixed to a corresponding contact surface, without performing any sealing function.

The microsuction structure provides an effective closure means for securing the lid in the closed position relative to the housing. Because the microsuction structure relies on the use of negative pressure for providing a closing force, rather than, for example, chemical adhesion, the microsuction structure is less likely to deteriorate and become less effective after several repetitions of opening and closing of the lid. Furthermore, because the microsuction structure can be provided in the form of a laminar material, it can be incorporated into containers for consumer goods without significant modification of existing container designs or packaging equipment.

Advantageously, loose material from the consumer goods, for example, loose tobacco from smoking articles, does not stick to the microsuction structure. This enables the appearance and the function of the microsuction structure to be retained during use.

The present invention is particularly suited to containers for consumer goods, where the lid is hinged to the housing and pivots relative to the housing between a closed position in which the lid covers the opening and an open position in which the opening is uncovered. This is because the pivoting movement on opening of the container can result in the microsuction layer being peeled away from the contact surface without any noticeable resistance to the user of the container. On the other hand, when the lid is pivoted into the closed position relative to the housing the microsuction layer can form a strong engagement with its contact surface and thereby provide an effective retaining means, without requiring any extra or different closing action to be undertaken by the user of the container.

The microsuction structure of the containers of the present invention incorporates a polymeric film layer underneath the microsuction layer.

The term "polymeric film layer" is used herein to refer to a continuous sheet of a flexible polymeric film, which is provided as an intermediate layer within the laminate microsuction structure and acts as a carrier layer for the overlying microsuction layer. The microsuction layer therefore bonds to the polymeric film layer rather than directly to the first surface of the housing or lid of the container and it is the polymeric film layer that is affixed to the first surface by means of the adhesive layer. It has advantageously been found that a strong bond can be formed between the polymeric film layer and the microsuction layer such that the microsuction layer can be securely provided on the surface of the container.

The polymeric film layer can be readily adhered to the corresponding first surface of the housing or lid by means of the adhesive layer. Preferably, the polymeric film layer is applied to at least a part of the surface of the one or more laminar blanks for forming the container according to the invention. In some preferred embodiments, the polymeric film layer is applied over substantially the entire surface of the laminar blank or blanks forming the portion of the container on which the microsuction structure is provided.

The microsuction layer is preferably fused directly onto the polymeric film layer, without an intermediate adhesive layer.

Preferably, the microsuction layer covers substantially the entire polymeric film layer so that the polymeric film layer is not exposed at the surface of the container. In some preferred embodiments, the microsuction structure is applied over substantially the entire surface of the laminar blank or blanks forming the portion of the container on which the microsuction structure is provided. The microsuction layer therefore also covers substantially the entire surface of the laminar blank or blanks. The laminar blank or blanks are therefore provided as a laminate structure incorporating the microsuction structure and the layer of cardboard or other material for forming the container.

Preferably, the polymeric film layer of the microsuction structure is a layer of a polyester film, particularly preferably a layer of polyethylene terephthalate (PET). Other suitable polymers for use in the polymeric film layer include but are not limited to polyethylene and oriented polypropylene.

Preferably the polymeric film layer has an average thickness of between about 20 micrometers and about 50 micrometers, more preferably between about 20 micrometers and about 30 micrometers, most preferably about 25 micrometers.

As described above, the microsuction structure is affixed to the first surface of the housing or lid by means of the adhesive layer, which underlies the polymeric film layer and provides a bond between the polymeric film layer and the corresponding first surface of the housing or lid. Preferably, the adhesive layer comprises a pressure adhesive which has a stronger sealing force with the first surface than is provided by the microsuction layer. This ensures that the microsuction structure is retained in place on the corresponding first surface as the lid is moved between the open and closed position and the contact between the microsuction layer and the adjacent contact surface is repeatedly made and broken.

Suitable adhesives for forming the adhesive layer may be water based adhesives or solvent based adhesives. Preferably, the adhesive layer is formed from a water based adhesive.

In certain preferred embodiments of the present invention, the microsuction structure further comprises an inactivation layer partially covering the microsuction layer, wherein the inactivation layer prevents the underlying area of the microsuction layer from becoming affixed to a contact surface. The inactivation layer is preferably in the form of a suitable lacquer, which is applied over one or more areas of the microsuction layer.

The inactivation layer acts to cover and "inactivate" the micro cavities in the microsuction layer so that they can no longer form a seal with a contact surface, as described above. The microsuction layer can therefore only seal effectively in the areas that are not coated by the inactivation layer and are exposed at the surface of the microsuction structure. The inactivation layer can be used to define specific resealable areas of exposed microsuction layer on the first surface of the lid or the first surface of the housing, or both. This advantageously enables control of the regions where sealing of the lid and the housing can occur which, in turn, enables control of the sealing force between the lid and the housing. The use of an inactivation layer to define specific resealable areas may be particularly beneficial when the microsuction structure is provided over an entire surface of the laminar blank or blanks for forming the lid or housing, as described above.

The inactivation layer can conveniently be applied onto the surface of the microsuction structure, prior to assembly of the container from the laminar blank or blanks. In this way, the resealable area or areas in which the microsuction layer is exposed can be accurately positioned on the blank so that they are provided in the desired position on the assembled container, without the need for any registration steps during the assembly process.

If desired, the areas to which the inactivation layer is applied may be printed with a suitable ink prior to the application of the inactivation layer onto the microsuction layer. Such printing can modify the surface appearance in these areas. In such embodiments, the inactivation layer can further act to protect said printing from being inadvertently degraded, for example by a consumer's fingers. Alternatively, a suitable printed ink may be provided on top of the inactivation layer after the inactivation layer has been provided on the microsuction layer.

Such selective printing may be helpful where it is desired for the consumer to be able to identify the position of the resealable area or areas of the microsuction structure. The ink may be printed onto the microsuction layer using any suitable printing process, including but not limited to flexographic printing, gravure printing, offset printing or digital printing. Preferably, the ink is printed using a flexographic printing process or a gravure printing process, most preferably a flexographic printing process.

Preferably, the microsuction layer is exposed over a surface area of at least 1 centimeter squared on the first surface of the lid or the first surface of the housing, more preferably at least 3 centimeters squared on the first surface of the lid or the first surface of the housing. Preferably, the microsuction layer is exposed over a surface area of less than 10 centimeters squared on the first surface of the lid or the first surface of the housing. This corresponds to the total surface area of the resealable areas.

Preferably, the microsuction structure has a total thickness of less than about 300 micrometers, more preferably a thickness of less than about 150 micrometers, even more preferably a thickness of less than about 50 micrometers. Preferably, the microsuction structure has a thickness of at least about 20 micrometers, more preferably at least about 60 micrometers. Ensuring that the thickness of the microsuction structure is within the aforementioned ranges eliminates the need for significant modification of the container dimensions.

Preferably, the microsuction structure is provided such that the force required to separate the lid from the housing when the lid is in the closed position is less than about 15 Newtons. This can ensure that the container is still relatively easy to open when a consumer wishes to access the consumer goods.

Preferably, the force required to separate the lid from the housing when the lid is in the closed position is at least about 2 Newtons, more preferably at least about 5 Newtons. This can reduce the likelihood of the lid accidentally being opened during normal handling of the container, for example, when the container is in a consumer's pocket.

When the lid of containers according to the invention is in the closed position, the first surface of the lid is disposed adjacent to the first surface of the housing so that the surfaces overlap with each other over a first overlapping area. Additional surfaces of the lid and housing may also be disposed adjacent to each other in the closed position of the lid, depending on the position and size of the first surfaces. The total overlapping area between the surfaces of the lid and the surfaces of the housing may therefore be the same as the first overlapping area, or it may be larger.

Preferably, the first overlapping area is substantially the same as the total overlapping area so that the microsuction structure is provided over substantially the entire area in which the surfaces of the lid and the housing are overlapping. This would be the case, for example, where the microsuction structure is provided over substantially the entire surface of the laminar blank, as described above. Alternatively, the microsuction structure may only be provided in specific areas of the overlapping surfaces of the lid and the housing, so that the first overlapping area is less than the total overlapping area.

Preferably, the resealable areas of the microsuction structure over which the microsuction layer is exposed have a total surface area of at least 25 percent of the total overlapping area of the lid and the housing. Preferably, the total surface area of the resealable areas of the microsuction structure corresponds to 100 percent or less of the total overlapping area of the lid and the housing.

The microsuction structure as described is provided on at least one of the first surface of the lid and the first surface of the housing, so that the lid can be secured when the first surfaces are brought into contact with each other in the closed position of the lid.

In some preferred embodiments, a microsuction structure is provided on the first surface of the lid, and a microsuction structure is also provided on the first surface of the housing. This can enhance the retention effect provided by the microsuction structures as they can attach to each other when the lid is in the closed position.

Alternatively, in some other preferred embodiments, the microsuction structure is provided on only one of the first surface of the lid or the first surface of the housing. This can be advantageous as it means that only one surface of the lid or housing needs to be modified to incorporate an additional element. The remaining "contact" surface may therefore remain unmodified. However, in some such embodiments, it is preferred for the contact surface to have a surface smoothness of 1.2 micrometers or less as measured in accordance with ISO 8791-4, preferably a surface smoothness of 0.8 micrometers or less as measured in accordance with ISO 8791-4. This can improve the interaction between the microsuction structure and the contact surface of the lid or housing, and thereby improve the retention effect provided by the microsuction structure.

Such a surface smoothness may be provided by any suitable means. However, in some particularly preferred embodiments, the contact surface of the lid or housing comprises a coating layer to increase the surface smoothness. For example, the contact surface may comprise a coating layer of a varnish, such as an ultraviolet (UV) cured varnish. The varnish may be easy to apply locally to the contact surface of the lid or housing. This means that significant modification of the remainder of the container is not necessary, in order to ensure that contact surface has a desired smoothness of 1.2 micrometers or less.

The first surface of the lid or housing onto which the microsuction structure is applied may optionally be embossed in order to raise at least a part of the first surface relative to the surrounding surface of the container. This may advantageously enhance contact between the microsuction structure and the contact surface, in order to provide an optimised seal. Such embossing can be achieved using a high aspect ratio lacquer.

Where embossments are provided, the depth of the embossments is preferably between about 20 micrometers and about 100 micrometers, more preferably between about 30 micrometers and about 70 micrometers, most preferably between about 30 micrometers and about 50 micrometers. Preferably, at least about 50 percent of the first surface is covered by embossments, more preferably at least about 75 percent of the first surface and most preferably about 100 percent of the first surface.

Preferably, the microsuction structure is provided on the first surface of the housing. In such embodiments, the microsuction structure is preferably provided on the front wall of the housing such that there is at least one resealable area on the front wall of the housing. The corresponding first surface on the lid will therefore typically be the inner surface of the lid front wall. Alternatively or in addition, the microsuction structure may be provided on at least one of the side walls of the housing such that there is at least one resealable area on the side wall. In this case, the corresponding first surface of the lid will typically be the inner surface of the corresponding lid side wall.

Alternatively or in addition, the microsuction structure may be provided on the first surface of the lid. In such embodiments, the microsuction structure is preferably provided on the inner surface of the front wall of the lid such that there is at least one resealable area on the front wall of the lid. Alternatively or in addition, the microsuction structure may be provided on the inner surface of at least one of the side walls of the lid such that there is at least one resealable area on the side wall.

In one preferred embodiment, a first microsuction structure is provided on the outer surface of the front wall of the inner frame, and one or more additional microsuction structures are provided on the inner surface of each of the side walls of the lid. In another preferred embodiment, a first microsuction structure is provided on the inner surface of the lid front wall, and one or more additional microsuction structures are provided on the outer surface of each of the side walls of the inner frame.

The housing and lid of containers according to the invention may have any suitable structure. However, in some particularly preferred embodiments, the housing comprises a box comprising: a box front wall, a box back wall, first and second box side walls, and a box bottom wall, wherein the first surface of the housing is located on the box front wall. The lid is typically connected to the box along a hinge line extending across the back wall of the container. In such embodiments, in the closed position of the lid, at least part of the lid front wall overlies the box front wall and the first surface of the lid is located on the inner surface of the lid front wall.

As used herein the terms "side", "top", "bottom", "front", "back" and other terms used to describe relative positions of the components of containers according to the invention refer to the container in an upright position with the lid at the top and the box bottom wall at the bottom. When describing containers according to the present invention, these terms are used irrespective of the orientation of the container being described.

In other preferred embodiments of the invention, the housing comprises a box as defined above and an inner frame mounted within the box, wherein the first surface of the housing is located on the inner frame. In such embodiments, the walls of the inner frame extend beyond the top edges of the corresponding walls of the box at the opening of the housing so that when the lid is in the closed position, the walls of the lid overlie the corresponding walls of the portion of the inner frame extending above the box. Particularly preferably, the microsuction structure is provided on the first surface of the housing, on the inner frame. The first surface of the lid may or may not be provided with an additional microsuction structure.

Where the microsuction structure is provided on the inner frame, as described above, the microsuction structure may be provided over a specific area or areas of the inner frame surface. More preferably, the microsuction structure is provided over substantially the entire outer surface of the inner frame. In this case, the microsuction structure can conveniently be applied as a single, continuous element on the surface of the inner frame to provide a laminated inner frame. The inner frame can be provided with the microsuction structure prior to the assembly of the container so that the container assembly process is substantially unaffected by the inclusion of the microsuction structure on the inner frame.

Where the microsuction structure is provided on the inner frame, the microsuction structure may additionally be used to affix the inner frame to the inner surface of the box. Conventionally, such inner frames are affixed to the inner surface of the box by means of an adhesive. However, by leaving one or more portions of the microsuction layer exposed in the region of the inner frame that underlies the inner surface of the box, the microsuction layer itself can be used to help affix the inner frame to the inner surface of the box. This can advantageously reduce or eliminate the amount of adhesive needed.

In such embodiments in which the microsuction structure covers substantially the entire outer surface of the inner frame, the microsuction structure preferably comprises an inactivation layer as described above, to define specific resealable areas on the inner frame walls, in which the microsuction layer is exposed. This enables the area over which the lid will become sealed to the inner frame in the closed position of the lid to be controlled so that the force required to open the lid is appropriate for the consumer. Preferably, at least one resealable area is provided on the front wall of the inner frame. Alternatively or in addition, at least one resealable area may be provided on a side wall of the inner frame, or on both side walls of the inner frame.

In any of the embodiments described above in which the housing comprises a box, the lid may comprise a flap that is hinged to the box, the flap comprising a top flap portion that overlies the top of the box when the flap is in the closed position and a front flap portion that at least partly overlies the box front wall when the flap is in the closed position, and wherein the first surface of the lid is located on the inner surface of the front flap portion. Preferably, the box comprises a top wall at least partially defining the opening for accessing the consumer goods, in which the opening extends across the top wall from the front edge of the top wall and wherein the periphery of the opening is spaced apart from the rear edge and the side edges of the top wall so that the top wall extends around the rear and sides of the opening. Preferably, the opening also extends part way down the box front wall from the front edge of the box top wall, and when the flap is in the closed position, the front flap portion overlies the part of the opening that extends part way down the box front wall and also overlies at least a part of the overlies the box front wall.

Alternatively, in any of the embodiments described above in which the housing comprises a box, the lid may comprise a lid front wall, a lid back wall, first and second lid side walls, and a lid top wall, and wherein the first surface of the lid is located on the inner surface of the lid front wall. Preferably, the lid front wall comprises a lid front wall outer panel defining the outer surface of the lid front wall, and a lid front wall under panel defining the inner surface of the lid front wall. In such an embodiment, the lid front wall under panel depends from and underlies the lid front wall outer panel. This arrangement is particular advantageous for embodiments in which the container is formed from a folded laminar blank, and in which the first (inner front wall) surface of the lid is provided with a varnish, because the varnish can to be applied to the first (inner front wall) surface of the lid using existing manufacturing machinery and techniques.

The term "panel" is used herein to refer to a portion of the container formed from a single, continuous portion of material. A panel may depend along one or more weakening lines from one or more other panels. The term "flap" refers to a panel that depends along only one weakening line from only one other panel.

The term "wall" refers more generally to a facet of the container, and a wall may be formed from a single panel or flap, or a wall may be formed from two or more abutting or overlapping panels or flaps.

Containers produced by methods according to the present invention are preferably in the form of a hard-pack container which has a relatively rigid three dimensional structure.

Containers according to the present invention find application for consumer goods, in particular elongate consumer goods such as smoking articles. Preferably, the container contains a bundle of smoking articles within the housing. It will be appreciated that through appropriate choices of the dimensions thereof, containers according to the invention may be designed for different numbers of conventional size, king size, super-king size, slim or super-slim cigarettes. Alternatively, other consumer goods may be housed inside the container.

Preferably, the container is formed from one or more folded laminar blanks. The one or more folded laminar blanks may be formed from any suitable material or combination of materials, including, but not limited to, cardboard, paperboard, plastic, metal, or combinations thereof. Preferably, the blank is a laminar cardboard blank having a weight of between about 100 grams per square meter and about 350 grams per square meter. In preferred embodiments, the blank has a thickness of from about 200 to about 400 micrometers, more preferably from 250 micrometers to 350 micrometers.

The container is preferably a rectangular parallelepiped container comprising two wider walls spaced apart by two narrower walls. A hinge lid container shall typically comprise two longitudinal rounded or bevelled edges on the front wall, and/or two longitudinal rounded or bevelled edges on the back wall. These may optionally be in combination with one or more rounded or bevelled transverse edges.

The exterior surfaces of containers according to the invention may be printed, embossed, debossed or otherwise embellished with manufacturer or brand logos, trade marks, slogans and other consumer information and indicia.

According to the invention there is further provided a method of producing a container according to the invention, as defined above, the method comprising: providing one or more laminar blanks for forming the lid and the housing of the container; laminating a polymeric film layer over at least a portion of the surface of a first laminar blank by applying an adhesive layer between the polymeric film layer and the surface of the first laminar blank; applying a microsuction layer onto the polymeric film layer over a first surface of the first laminar blank; and assembling the container from the one or more laminar blanks.

Preferably, the method according to the invention further comprises the step of applying an inactivation layer over one or more areas of the microsuction layer such that only a portion of the microsuction layer remains exposed for sealing to a contact surface, as described above.

Preferably, in methods according to the invention, the first laminar blank is a laminar blank for forming an inner frame and the polymeric film layer and the microsuction layer are applied over substantially the entire outer surface of the inner frame laminar blank.

Figure 2:
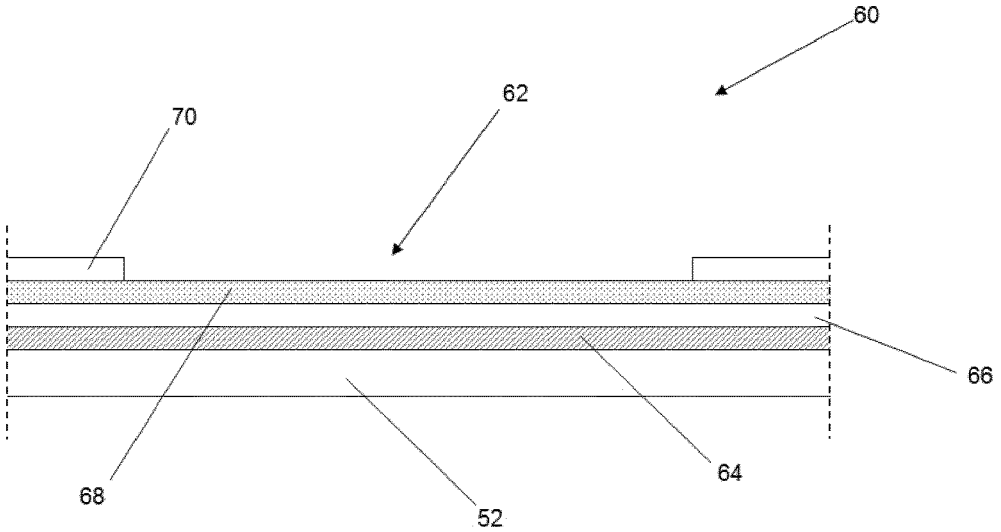

The invention will be further described, by way of example, with reference to the drawings in which:

FIG. 1 is a perspective view of a container according to the present invention; and FIG. 2 is an enlarged partial cross-sectional view of the microsuction structure on the front wall of the inner frame of the container of FIG. 1 (not to scale).

FIG. 1 shows a container 100 for consumer goods, according to an embodiment of the present invention, where the container 100 is in an open condition. The container 100 contains a wrapped bundle of consumer goods 60, such as a bundle of cigarettes. The container is formed from a folded laminar blank and has a lid 40 and a box 20.

The lid 40 has a first lid side wall 42, a second lid side wall 44, and a lid top wall 46. The lid 40 also has a lid front wall 48 and a lid back wall (not shown).

The box 20 has a box front wall 22, and a first box side wall 24. The box 20 also has a box bottom wall, a box back wall and a second box side wall (not shown). The lid 40 depends along a hinge line (not shown) from a top edge of the box back wall, and is movable about the hinge line between an open position (as shown in FIG. 1) and a closed position (not shown).

An inner frame 50 is attached to the inside of the box 20 and includes a first inner frame side wall 54, a second inner frame side wall (not shown), and an inner frame front wall 52.

A microsuction structure 60 is provided over the entire outer surface of the inner frame 50 and comprises a resealable area 62 on the inner frame front wall 52, which is configured to engage with the inner surface of the lid front wall 48 to retain the lid 40 in a closed position relative to the box 20.

FIG. 2 shows a partial cross-sectional view of the microsuction structure 60 provided on the outer surface of the inner frame 50. The microsuction structure 60 is formed of a laminate sheet material comprising several layers overlying one another, which covers the entire outer surface of the inner frame 50. An adhesive layer 64 adheres the microsuction structure 60 to the outer surface of the inner frame 50. A polymeric film layer 66 formed of a film of PET is adhered onto the adhesive layer 64 and a microsuction layer 68 overlies the polymeric film layer 66. The microsuction layer 68 is exposed in an area on the surface of the inner frame front wall 52 and this exposed area provides the resealable area 62 described above. The remainder of the microsuction layer 68 is covered by an inactivation layer 70 of a lacquer. The inactivation layer 70 is applied over the microsuction layer 68 and prevents the microsuction layer 68 from adhering to the lid, other than in the resealable area 62.

As described above, the areas to which the inactivation layer 70 is applied may be printed with a suitable ink prior to the application of the inactivation layer 70 onto the microsuction layer 68, in order to modify the surface appearance in these areas.

To close the container the consumer pivots the lid 40 about the hinge relative to the box 20, until the inner surface of the lid front wall 48 is adjacent to the outer surface of the inner frame front wall 52. The application of pressure to the outer surface of the lid front wall 42 causes the resealable area 62 of the microsuction structure 60 on the inner frame front wall 52 to engage with the inner surface of the lid front wall 48, and thereby retain the lid 40 in the closed position.

It will be appreciated that in alternative embodiments, the application of the lacquer layer 70 may be adapted to provide one or more additional resealable areas in which the microsuction layer is exposed at the surface of the inner frame. For example, an additional resealable area may be provided on one or both of the inner frame side walls.

The invention claimed is:

1. A container for consumer goods, the container comprising:

a housing having an opening for accessing the consumer goods; and a lid connected to the housing and movable relative to the housing between a closed position in which the lid covers the opening and an open position in which the opening is uncovered;

wherein a first surface of the lid is disposed adjacent to a first surface of the housing when the lid is in the closed position, and wherein a microsuction structure is provided on the first surface of the housing, the first surface of the lid, or both the first surface of the housing and the first surface of the lid, for securing the first surface of the lid to the first surface of the housing when the lid is in the closed position, the microsuction structure comprising:

a microsuction layer, at least part of which is exposed at the outer surface of the microsuction structure;

a polymeric film layer underlying the microsuction layer; and an adhesive layer underlying the polymeric film layer and affixing the microsuction structure to the corresponding first surface of the lid or housing.

2. A container according to claim 1 wherein the polymeric film layer is a layer of polyethylene terephthalate (PET).

3. A container according to claim 1 wherein the microsuction structure further comprises an inactivation layer partially covering the microsuction layer, wherein the inactivation layer prevents the underlying microsuction layer from becoming affixed to a contact surface.

4. A container according to claim 1 wherein a microsuction structure is provided on the first surface of the lid, and a microsuction structure is provided on the first surface of the housing.

5. A container according to claim 1 wherein the microsuction structure is provided on only one of the first surface of the lid or the first surface of the housing, and wherein the other of the first surface of the lid or the first surface of the housing has a surface smoothness of 1.2 micrometers or less as measured in accordance with ISO 8791-4.

6. A container according to claim 5, wherein the other of the first surface of the lid or the first surface of the housing comprises a coating layer to increase the surface smoothness.

7. A container according to claim 1 wherein the first surface of the lid or the first surface of the housing to which the microsuction structure is applied is embossed beneath the microsuction structure.

8. A container according to claim 1 wherein the housing comprises a box and an inner frame mounted within the box, wherein the first surface of the housing is provided on the inner frame.

9. A container according to claim 8 wherein the microsuction structure is provided over the entire outer surface of the inner frame.

10. A container according to claim 1 wherein the polymeric film layer of the microsuction structure is applied over the entire outer surface of the inner frame.

11. A container according to claim 1 wherein the force required to separate the lid from the housing when the lid is in the closed position is between about 5 Newtons and about 15 Newtons.

12. A container according to claim 1 wherein the microsuction layer of the microsuction structure is exposed over a surface area of at least 1 square centimeter on the first surface of the lid or the first surface of the housing.

13. A container according to claim 1 wherein the lid comprises a lid front wall, a lid back wall, first and second lid side walls, and a lid top wall, and wherein the first surface of the lid is located on the inner surface of the lid front wall.

14. A container according to claim 1 containing a bundle of smoking articles within the housing.

15. A method of producing a container according to any preceding claim, the method comprising:

providing one or more laminar blanks for forming the lid and the housing of the container;

laminating a polymeric film layer at least a portion of the surface of a first laminar blank by applying an adhesive layer between the polymeric film layer and the surface of the first laminar blank;

applying a microsuction layer onto the polymeric film layer over a first surface of the first laminar blank; and assembling the container from the one or more laminar blanks.

* * * * *